United States Patent [19]

Wolff

[11] Patent Number: 5,056,268

[45] Date of Patent: Oct. 15, 1991

[54] ACCESSORY DEVICE FOR ANGLE GRINDER

[75] Inventor: Robert Wolff, Engeln, Fed. Rep. of Germany

[73] Assignee: Werkzeug GmbH, Weibern, Fed. Rep. of Germany

[21] Appl. No.: 598,942

[22] Filed: Oct. 17, 1990

[30] Foreign Application Priority Data

Oct. 23, 1989 [DE] Fed. Rep. of Germany ..... 3935179

[51] Int. Cl.[5] ..... B24B 23/04

[52] U.S. Cl. ..... 51/170 MT

[58] Field of Search ..... 51/170 R, 170 TL, 170 MT

[56] References Cited

U.S. PATENT DOCUMENTS 2,332,613 10/1943 Swank .
2,350,098 5/1944 Decker ..... 51/170 TL
2,614,369 10/1952 Robins .

FOREIGN PATENT DOCUMENTS 0333933 9/1989 European Pat. Off. .
7626861 3/1977 Fed. Rep. of Germany .
2745129 4/1979 Fed. Rep. of Germany .
3805926 9/1989 Fed. Rep. of Germany .... 51/170 R

OTHER PUBLICATIONS

AEG Heimwerker-System, Technikmit Zukunft, Feb. 1978 (4 pages).

*Primary Examiner*—Roscoe V. Parker
*Attorney, Agent, or Firm*—Antonelli, Terry, Stout & Kraus

[57] ABSTRACT

Accessory devices for a hand driven tool such as, for example, an angle grinder with the accessory device including an eccentric unit and a resilient coupling for a toolholder whereby an oscillating, elliptical path of movement is imparted to the toolholder in an operating range of the hand driven tool. The eccentric unit and the resilient coupling form one module with the toolholder forming an independent structural assembly thereby enabling the toolholder to be readily exchangeable.

21 Claims, 6 Drawing Sheets

ACCESSORY DEVICE FOR ANGLE GRINDER

DESCRIPTION

1. Technical Field

The present invention relates to an angle grinder and, more particular, to an accessory device for angle grinder which enables the angle grinder to execute a reciprocating movement in dependence upon the eccentricity and a superimposed pivoting motion.

2. Background Of The Invention

Angle grinders have been proposed which include an eccentric head adapted to be threaded directly onto an output to drive spindle of the hand grinders, with the eccentric head acting by way ball bearing, on a toolholder, with a freedom of movement of the toolholder being restricted by a resilient coupling means attached to a housing of the angle grinder to a reciprocating movement in dependence upon the degree of eccentricity and to superimposed pivoting movement about a resilient point of a coupling means.

In, for example, DE-OS 2,745,129 and German Utility Model 7,626,861, grinders are proposed wherein eccentric heads are threaded directly onto an output drive spindle of the hand grinders, such as, angle grinders, and include, on an underside thereof, a pivot bearing arranged eccentrically to the output drive spindle, with a grinding disk being attached to the pivot bearings. In simple hand grinders, the grinding disk is driven in a purely rotational fashion, with a relatively slow rotational movement of grinding disk resulting with interposition of the eccentric head. The relatively slow rotational movement is superimposed by a rapid circular motion in dependence upon the eccentricity of the eccentric head. By virtue of the movement superposition, a very satisfactory grinding finish is obtained; however, in the above-proposed construction, there is no possibility of completely grinding surfaces delimited by two edge areas which converge toward each other.

Since about 1978, AEG house produced oscillator grinder models SS 707 and SS 717 wherein a toolholder, including an eccentric ball bearing, is resiliently coupled to parts rigidly connected to a drive machine housing by four rubber buffers arranged in a rectangular fashion in such a manner that a rotary movement of the toolholder is prevented and the toolholder thus executes a small oscillating circulatory movement in correspondence with the eccentricity of the ball bearing. These proposed oscillating grinders are designed as attachments for hand-operated machines as shown in an AEG catalog entitled "Home Handyman's System", February, 1978; however, these proposed oscillating grinders are not suitable for grinding zones along edges or along relatively narrow corner zones.

In, for example, U.S. Pat. No. 2,350,098, yet another angular hand grinder is provided wherein the output spindle is provided with an eccentric acting, by way of eccentrically arranged ball bearing, on a strip-shaped toolholder, with the freedom of movement of the toolholder being limited by a pin attached to a grinder housing and engaging in a slotted hole of the strip-shaped toolholder, to a reciprocating motion in the longitudinal direction of the strip-shape and to a superimposed pivotal motion about the pin so that the toolholder describes an elliptical movement path a forward free end. At a frontal free end portion of the toolholder, a rectangular grinding pad is provided; however, since the movement of the grinding pad toward the front, that is, along the minor axis of the elliptical path of motion, is relatively small, this proposed angular hand grinder is suitable for grinding and high precision grinding on longitudinal edges and into corners.

In this connection, in the last proposed construction, a high precision grinding action is possible by the elliptical circulating motion of the individual abrasive grain, with the grinding disk there being worn off almost uniformly along an entire surface area; however, this proposed construction must be purchased as a single apparatus since its eccentric head and the toolholder articulation are integrated into the basic appliance and are not constructed as an accessory device.

DE-OS 3,805,926 also proposes various constructions of an accessory device of the aforementioned type wherein, in each case, the toolholder is undetachably connected to the eccentric head by way of the ball bearing, and wherein, the toolholder is articulated directly by way of a resilient rubber buffer, to an adapter member attached to the angle grinder.

In the last described constructions, when the toolholder is changed, the entire accessory device must, in each case also be exchanged thereby leading to a relatively expensive set of accessories and/or to an expensive exchange or replacement in case of a damaged toolholder.

SUMMARY OF THE INVENTION

The aim underlying the present invention essentially resides in providing an accessory device for angle grinders of the aforementioned type which avoids, by simple means, shortcomings and disadvantages encountered in the prior art and is readily adaptable for retrofitting all types of existing angle grinders while permitting an economical manufacture of a set of differing toolholders.

In accordance with advantageous features of the present invention, an accessory device for an angle grinder is provided wherein an outer race of the ball bearing is arranged eccentrically in a rotating eccentric head, and a central internally threaded bushing is mounted in the inner race. A coupling means is provided which includes a fishplate which is adapted to be threaded in place by way of threaded hole provide in a handle of the angle grinder, with a radially projecting overhanging member resiliently being connected to the fishplate and attached a lower end face of the central internally threaded bushing. The toolholder is fashioned as structurally separate component from the coupling means and the eccentric, with the component being itself exchangeable.

By virtue of the above-noted features of the present invention, the accessory device may be retrofitted or mounted on almost of any type of existing angular hand grinders by virtue of the provision of the thread-on fishplate since, the thread of the output spindle of such grinders is standardized and, for resilient articulation, the presented invention utilizes the threaded holes generally provided for enabling a threading of auxiliary handles in place, which threaded holes are arranged at the head of a conventional angle grinders on respective sides thereof. Consequently, there is no need to provide any additional special adapters at the head of the angle grinder.

Yet a further advantage of the present invention resides in the fact that, when the tool holder is changed, the eccentric head together with the ball bearing assembly and also the resilient coupling means remain at the angle grinder and, it only necessary to exchange or replace, for example, one toolholder due to wear and replace the same with another toolholder and/or another type of toolholder. In this manner, it is possible to associate an angle grinder with a set of differing toolholders in a relatively inexpensive fashion.

Moreover, by virtue of the present invention, it is possible to provide, depending on the specific grinding task or operation, to provide grinding disks which project in finger-like fashion, or toolholders having an arcuate or triangular or, preferably, oblong hexagonal-shaped form wherein forward and rearward corners of the hexagonal-shaped toolholders subtend an angle of 90°.

By providing a hexagonal-shaped toolholder, it is possible to provide for a grinding arrangement which most extensively realizes the advantages of a grinding disk having an arcuate triangular shape with those of grinding disk which project in a finger-like fashion.

Advantageously, in accordance with the present invention, a substantially cupped shaped overhanging member is provided which substantially extensively encompasses the eccentric head, with an extension portion projecting from the overhanging member in a direction toward the fishplate. The cup-member may be fixedly clamped in place together with the toolholder by a single fastening means such as, for example, a single head screw, on the internally threaded bushing, whereby the manufacturing expense and labor for exchanging the toolholders are substantially reduced.

In accordance with still further features of the present invention the cupped shaped overhanging member and the fishplate are connected by way of an elastic buffer, with connecting surfaces of the fishplate and buffer extending substantially perpendicular to a plane of the toolholder and in parallel to a vertical traverse center plane of the accessory device. The radially extending or projecting portion provided on the overhanging member may, for example, include a slotted hole extending in parallel to a longitudinal axis of the angle grinder, with the fishplate engaging into the slotted hole by way of a pin extending from a lower end of the fishplate and functioning as an articulating axle.

In accordance with yet further features of the present invention, the accessory device may include an articulating unit comprising a connecting member extending approximately in parallel to a plane of the toolholder, with the connecting member being supported at the radial projecting member and the fishplate so as to be pivotable about axis perpendicular to the plane of the toolholder.

The toolholder may be fashioned as a grinding disk having the shape of an elongated hexagon wherein mutually opposite corners disposed along a longitudinal axis of the toolholder, in each case, subtend an angle of 90°.

Additionally, so as to enhance the elliptical movement path, a threaded region or area in which the grinding disk is attached is disposed offset adjacent a longitudinal center point of the toolholder.

The above and other objects, features, and advantages of the present invention will become more apparent from the following description when taken in connection with the accompanying drawings which so, for the purpose of illustration only, several embodiments in accordance with the present invention.

DETAILED DESCRIPTION

Figure 1:
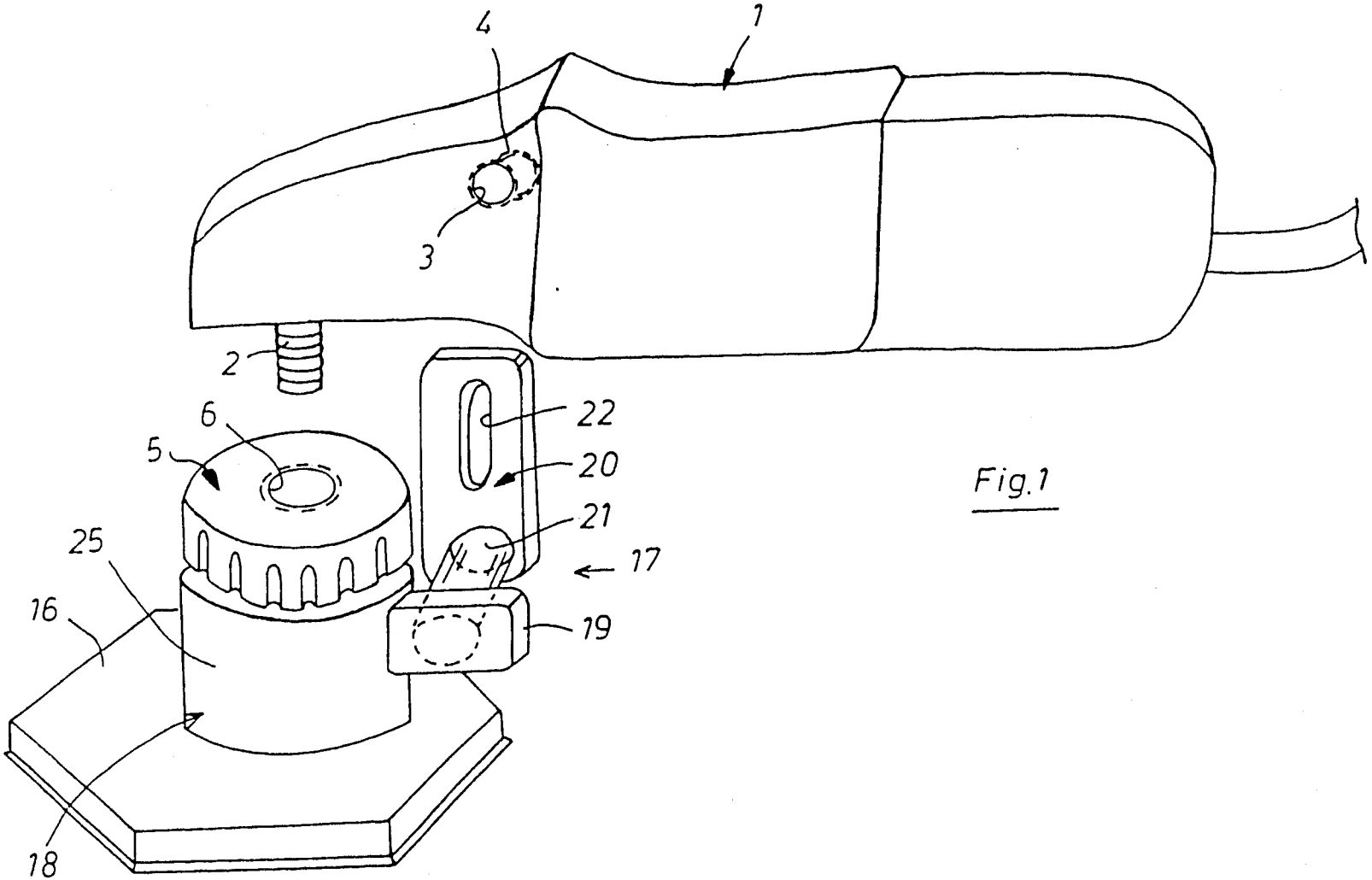
FIG. 1 is a schematic exploded perspective view of an angular hand grinder and accessory device constructed in accordance with the present invention.

Referring now to the drawing wherein like reference numerals are used to designate like parts and, more particularly, to FIG. 1, according to this figure, an angular hand grinder generally designated by the reference numeral 1 includes output drive spindle 2 provided with a standardized thread and, for example, two threaded holes 3, 4 arranged on respective sides of the head of the angular head grinder 1 for the threadably accommodating auxiliary handles (not shown).

Figure 2:
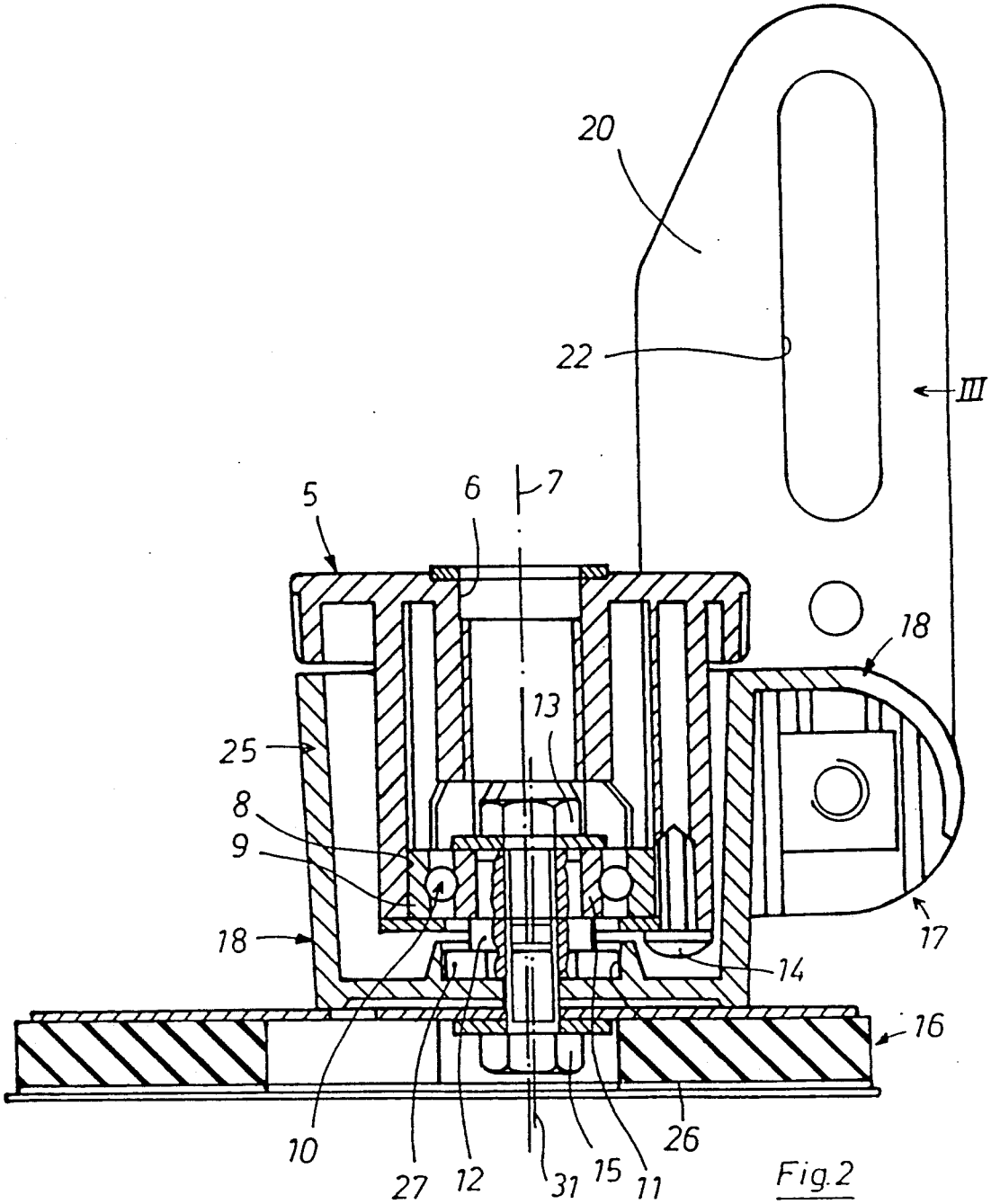
FIG. 2 is a vertical cross-section taken along a longitudinal center line of the accessory device of FIG. 1.

An accessory device in accordance with the present invention includes an eccentric head generally designated by the reference numeral 5 threadably mountable to an output spindle 2 by a threaded bore 6 so as to enable the eccentric head 5 and output spindle 2 to be rotatable together. As shown most clearly in FIG. 2, the eccentric head 5, at a lower end face thereof includes a mounting portion 8 eccentric with respect to a longitudinal center or drive axis 7 of the threaded bore 6. The mounting portion 8 accommodates an the outer race 9 of a grooved ball bearing assembly generally designated by the reference numeral 10, with an internally threaded bushing 12 being fixedly clamped to an inter-race of the bearing assembly 10 by a fastening means such as, for example, a head screw 13 threadably mounted from above into the internally threaded bushing 12. The outer race 9 of the ball bearing assembly !0 is fixedly clamped to the eccentric head 5 by several fasteners such as, for example, fillister head screws 14 distributed about a circumference of the eccentric head 5. The toolholder generally designated by the reference numeral 16 and an associated tool such as, for example, a grinding disk, may be connected to the eccentric ball bearing assembly 10 by a suitable fastener such as, for example, a head screw 15, introduced from below into the internally threaded bushing 12.

Figure 3:
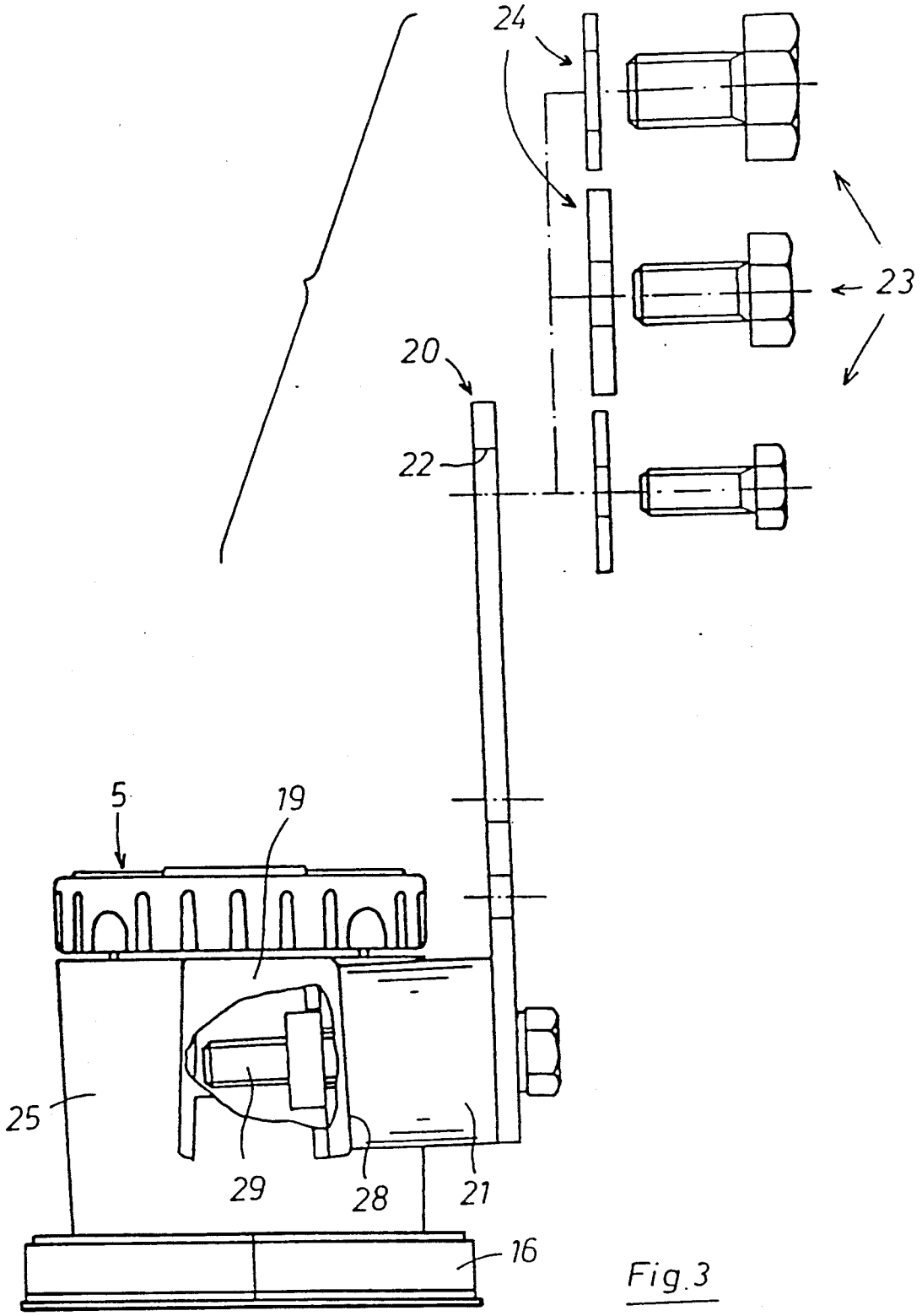
FIG. 3 is an exploded view of the accessory device taken in a direction of the arrow III in FIG. 2.
Figure 4:
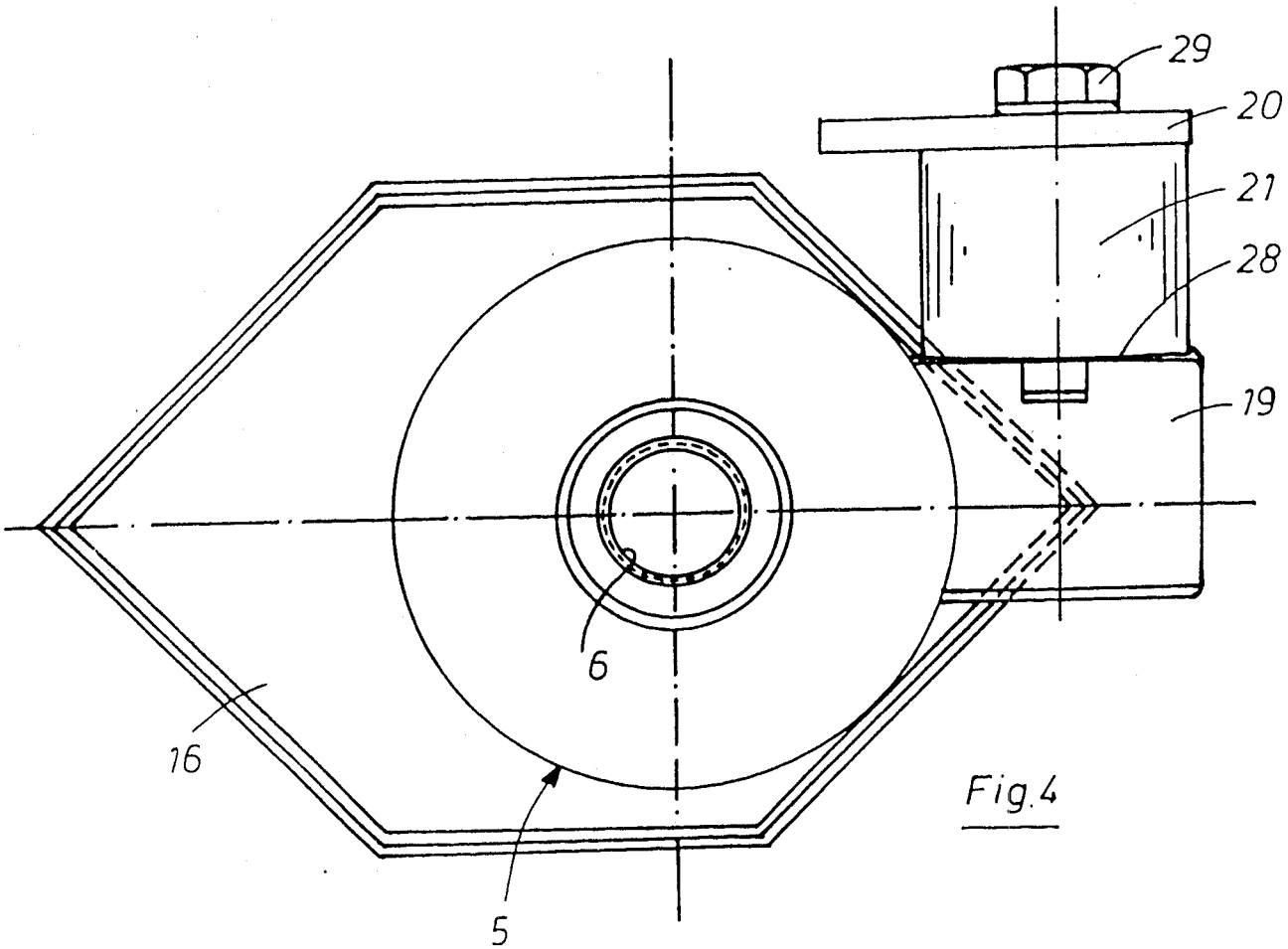
FIG. 4 is a top view of the accessory device of FIG. 1.

In order to achieve a purely oscillating drive of the toolholder 16 and associated grinding disk, that is, in order to avoid rotation of the grinding disk, the accessory device is provided with a resilient coupling means generally designated by the reference numeral 17 comprising an overhanging member generally designated by the reference numeral 18 directly clampable to the end face of the internally threaded bushing 12 with a cylindrical elastic resilient buffer or damper 21 (FIGS. 1, 3, 4 and 5) of, for example, rubber or the like clamped between a radially projecting extension 19 of the member 18 and a fishplate generally designated by the reference numeral 20. The fishplate 20 is oriented approximately perpendicularly to the toolholder 16 and is provided with a slotted hole 22 for enabling attachment of the angular hand grinder 1 by suitable fastening means such as, for example, a head screw (not shown) threadably inserted into the hole 4 located at the rear in angular hand grinder 1 in FIG. 1. In order to enable an accommodation of various angle grinding appliances, the accessory device is associated with a group of various head screws generally designated by the reference numeral 23 and shims generally designated by the reference numeral 24 of varying thickness, as shown most clearly in FIG. 3.

The member 18 of the resilient coupling means 17 is fashioned as a cup-shaped member 25 substantially extensively encompassing the eccentric head 5 and includes a hexagonal mounting portion 26 (FIG. 2) for accommodating the lower end of the threaded bushing 12 provided with a congruent hexagonal head 27 so as to enable the internally threaded bushing 12 to be mounted to the inner bottom of the cup-shaped member 25. The radially projecting extension is provided or fashioned on the exterior of the cup-shaped member 25 and is oriented generally toward a rear of the angular hand grinder 1, that is, toward the right of FIG. 1, beneath the angle grinder 1 during assembly. The radially projecting extension 19 includes a clamping surface 28 (FIGS. 2, 3 and 4) extending substantially perpendicular to the toolholder 16. The cylindrical rubber buffer 21 is fixedly clamped against the clamping surface 28 by a fastener means such as, for example, a head screw 29, extending through the buffer or damper 21 in such a manner that the longitudinal center axis of the cylindrical rubber buffer 21 extends substantially parallel to the toolholder 16 and simultaneously substantially parallel to a transverse center plane of the accessory device.

Figure 5:
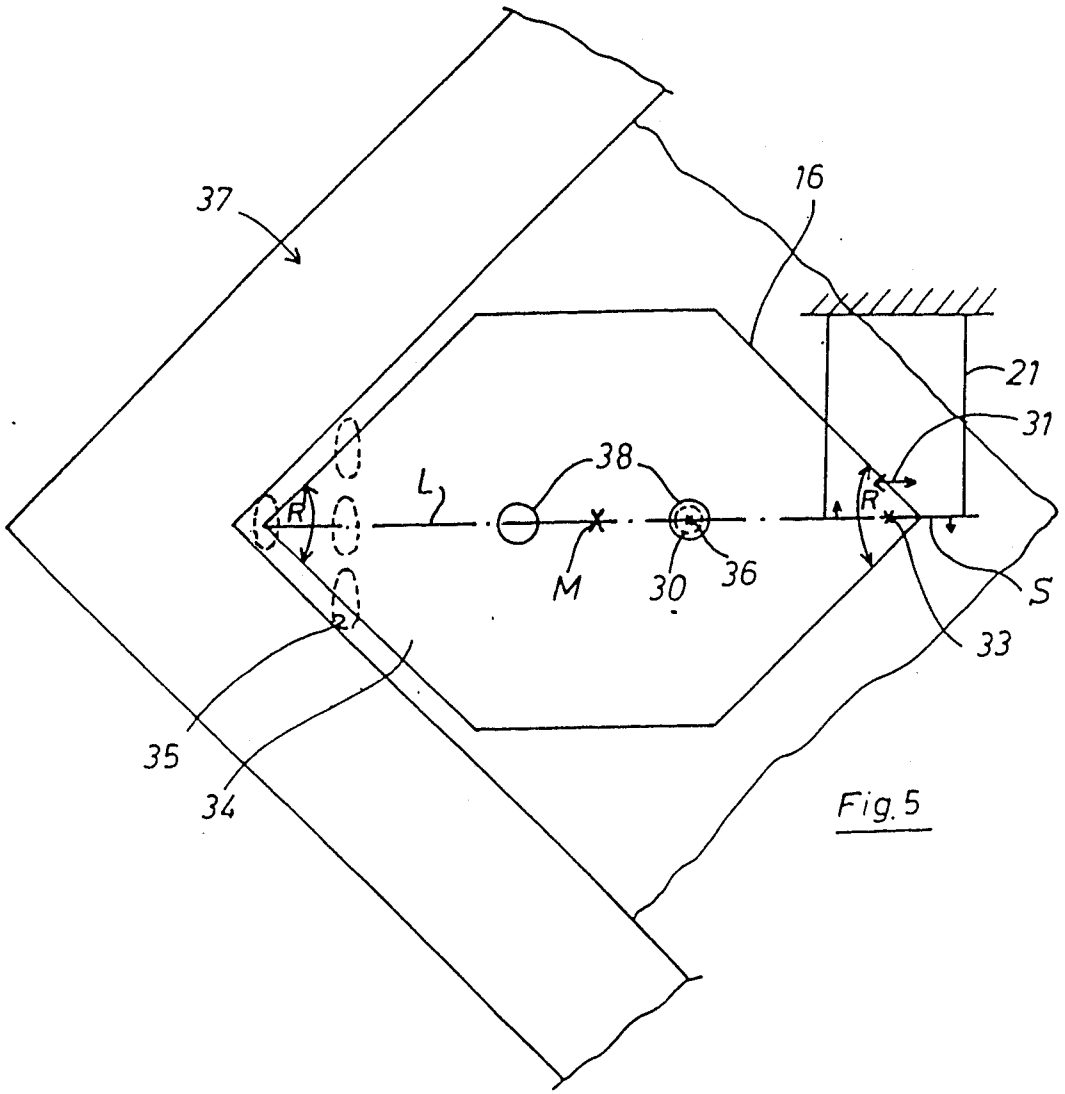
FIG. 5 is a schematic illustration depicting the paths of movement of a hexagonal grinding arrangement construction in accordance with the present invention.

As schematically illustrated in FIG. 5, upon a rotation of the eccentric head 5, the internally threaded bushing 12 and a zone of the toolholder 16 and associated grinding disk lying directly there beneath execute a circular path of motion 30; however, since the toolholder 16 is retained on a rear end thereof by the cylindrical rubber buffer or damper 21, the toolholder 16 and associated grinding disk performs a reciprocating motion in the direction of the double arrow 31 in a longitudinal direction, with an eccentricity of, for example, 0.5 millimeter between the drive axis 7 and the longitudinal center axis 32 of the internally threaded bushing 12 and, respectively, the ball bearing assembly 10, so that a stroke distance of 1 millimeter is obtained.

The cylindrical rubber buffer or damper 21 is continuously bent to and fro at an end face S over the stroke distance 31 which such action representing an uncritical stress on the cylindrical rubber buffer or damper 21. A transverse component of the circular path of motion 30 is however suppressed by the cylindrical rubber buffer or damper 21 at the rear end of the toolholder 16 so that the reciprocating movement of the toolholder 16 and associated grinding disk is superimposed by the pivotal motion about a coupling point 33 and the toolholder 16 and associated grinding disk executes, in its forward region 34 thereof, an elliptical movement along a path 35 illustrated in FIG. 5 on a greatly enlarged scale.

By virtue of the pivotal motion, the cylindrical rubber buffer or damper 21 is under a respective minimum compressive and elongation stress indicated by the short arrows at the end face S of the cylindrical rubber buffer or damper 21, and the cylindrical rubber buffer or damper 21 is not under torsional stress. The illustrated toolholder 16 and associated grinding disk 16 have an elongated hexagonal shape wherein the threading regions or areas 36 lies along a longitudinal axis L offset beside or adjacent a center point M of the toolholder 16 and associate grinding disk, an elliptical path of movement resulting having, for example, an eccentricity of 0.5 millimeter in the forward region 34 of the toolholder 16 and associated grinding disk, and with the minor axis of the elliptical path being 1 millimeter and the major axis being about 2–3 millimeters. The hexagonally shaped toolholder 16 and associated grinding disk have two opposing ends along the longitudinal axis L which, in each case, form a right angle R so that it is possible with such a toolholder 16 and associated grinding disk to work in optimal fashion along the edge and in a corner of a workpiece generally designated by the reference numeral 37 which may, for example, be a drawer or the like. The toolholder 16 and associated grinding disk are respectively provided on both sides of the longitudinal center point M with a thread-on perforations or opening 38 so that when the forward zone 34 has been worn down, the toolholder 16 and associated grinding disk can be shifted into a position turned by 180° and again be rethreaded into place.

Figure 6:
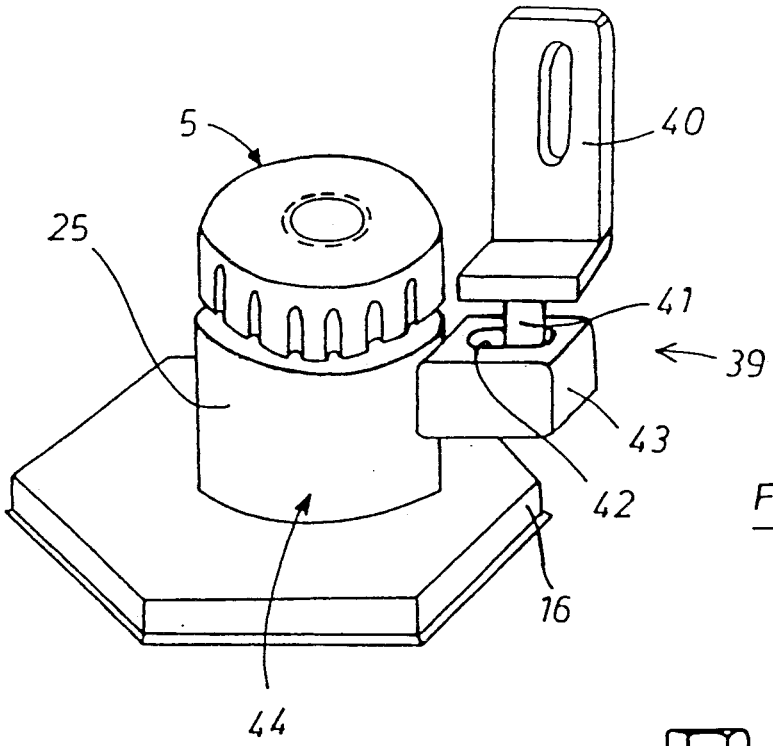
FIG. 6 is a perspective view of another embodiment of an accessory device for an angular hand grinder constructed in accordance with the present invention.

As shown in FIG. 6 a coupling generally designed by the reference numeral 39 of the accessory device for an angle grinder is provided, with the coupling 39 including a fishplate 40 having a downwardly oriented pin 41 at a lower end thereof, with the pin 41 being bent in a forward direction. The pin 41 is slidable engageable in a horizontal slotted hole 42 provided in a radial projection or extension portion 43 of an overhanging member 44 corresponding to the member 18. The slotted hole 42 has a width equal to a diameter of the pin 41 so that the pin 41 acts as an articulated axle. Advantageously, a length of the slotted hole 42 is considerably larger than a sum total of a diameter of the pin 41 and a desired stroke length such as, for example, the length of the stroke in the direction of the double arrows 31. For example, the length of the slotted hole 42 may be about 20 millimeters, to facilitate an adaptation of the accessory device to respective angle grinder appliances.

Figure 7:
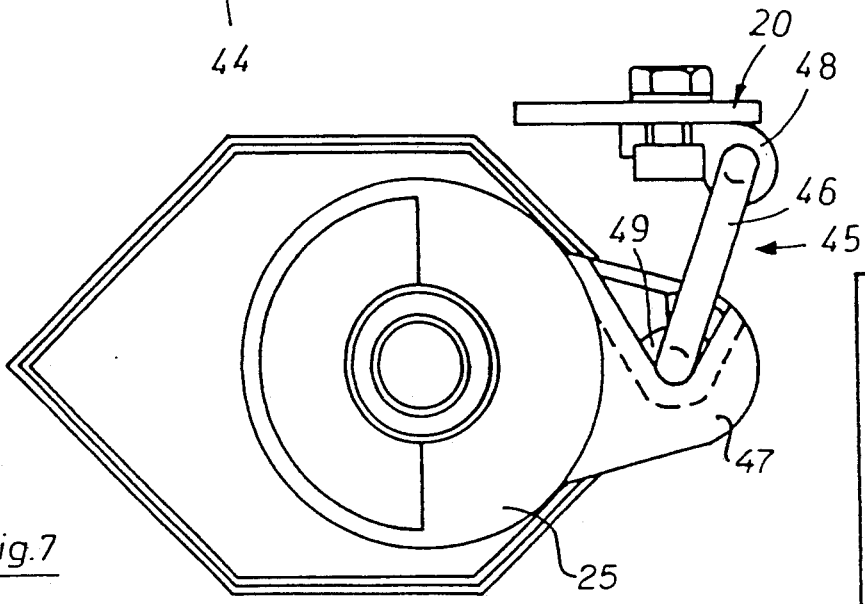
FIG. 7 is a top plan view of yet another embodiment of an accessory device for an angular hand grinder constructed in accordance with the present invention.
Figure 8:
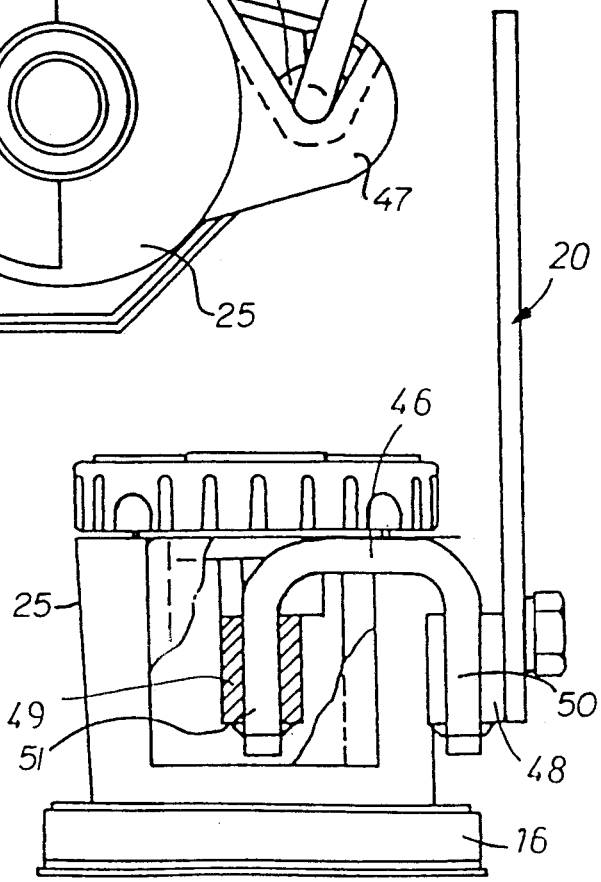
FIG. 8 is a side partially broken-away sectional view of the embodiment of FIG. 6.

FIGS. 7 and 8 provide yet another example of a coupling means generally designed by the reference numeral 45 construction in accordance with the present invention and including a connecting member 46 extending approximately in parallel to the plane of the toolholder 16, with the connecting member 46 being supported on a radially projecting or extending member 47. The fishplate 20 is adapted to be pivotable about axes perpendicular to the plane of the toolholder 16 and, for this purpose, a hinged bearing sleeve 48 is threaded onto the fishplate 20, and a bearing sleeve 49 is inserted in the radial projection or extension portion 47. Coupling axles 50, 51 are manufactured in one piece with the connecting member 46 and are fashioned of a round stock, and the connecting member 46 and coupling axles 50, 51 are a formed so as to provide a substantially U-shape connecting piece. Rather than provide simple bearing sleeves 48, 49, it is also possible to provide ball bearings in order to reduce bearing friction.

While the above description has been given in connection with a grinding disk, as can be readily be appreciated, the accessory device of the present invention is equally applicable to other types of toolholders and, for example, the toolholders may be provided for polishing, corner grinding, scraping and/or slotting.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. An accessory device for a driven hand tool including an output spindle means, the accessory device including a toolholder means, an eccentric head means adapted to be coupled to the output spindle means for rotation therewith, bearing means arranged in the eccentric head means and including an outer race means coupled to said eccentric head means, means resiliently coupling the toolholder means to a housing of the driven hand tool for restricting a freedom of movement of the toolholder means to a reciprocatory movement in dependence on the eccentricity and to a superimposed pivoting motion about the resilient point of the coupling means, and a central bushing means mounted in said outer race means, wherein said resilient coupling means includes a plate means adapted to be secured to a handle of the driven hand tool, a radially outwardly projecting member coupled to said central bushing means, and an elastic means interposed between said plate means and said radially outwardly projecting member wherein said toolholder means is an independent structural assembly separate from said resilient coupling means and said eccentric head means.

2. An accessory device according to claim 1, wherein means are provided in said plate means for enabling a threadable attachment of said plate means to the handle of the driven hand tool.

3. An accessory device according to claim 2, wherein said radially outwardly projecting member is coupled to a lower end face of said central bushing means.

4. An accessory device according to claim 2, wherein said bushing means includes an internal threading for securing a fastening means fixedly clamping said bushing means to said bearing means.

5. An accessory device according to one of claims 1, 2, 3, or 4, wherein a substantially cup-shaped member substantially completely encompasses an eccentric head means for coupling said central bushing means with said radially outwardly projecting member.

6. An accessory device according to one of claims 1, 2, 3 or 4, wherein the driven hand tool is an angle grinder, said toolholder means is adapted to accommodate a grinding disk having an elongated hexagonal shape, and wherein mutually opposite corners of said elongated hexagonal shape along a longitudinal axis thereof each subtend an angle of 90°.

7. An accessory device according to claim 5, wherein means are provided for fixedly securing said substantially cup-shaped member and said toolholder means to said central bushing means.

8. An accessory device according to claim 7, wherein said radially outwardly projecting member and said plate means have parallel connecting surfaces cooperable with corresponding connecting surfaces provided at respective opposite ends of said elastic member, and said connecting surfaces are disposed substantially perpendicular to a horizontally extending plane of the toolholder means and substantially parallel to a central transverse center plane of the accessory device.

9. An accessory device according to claim 8, wherein said toolholder means is adapted to accommodate one of a grinding means, polishing means, corner grinding means, scraping means and slotting means.

10. An accessory device for a driven hand tool including an output spindle means, the accessory device including a toolholder means, an eccentric head means adapted to be coupled to the output spindle means for rotation therewith, bearing means arranged in the eccentric head means and including an outer race means coupled to said eccentric head means, coupling means for coupling the toolholder means to a housing of the driven hand tool for restricting a freedom of movement of the toolholder means to a reciprocatory movement in dependence upon the eccentricity and to a superimposed pivoting motion about a point of the coupling means, and a central bushing means mounted in said outer race means, wherein said coupling means includes a plate means adapted to be secured to a handle of the driven hand tool, a radially outwardly projecting member coupled to said central bushing means, wherein said toolholder means is an independent structural assembly separate from said coupling means and said eccentric head means, and wherein said coupling means includes an elongated slot shaped hole provided in said radially outwardly projecting member extending in a direction substantially parallel to a longitudinal axis of the driven hand tool, and a pin means provided at a lower end of said plate means and engageable with said elongated slot shaped hole for forming an articulating axle.

11. An accessory device according to claim 10, wherein means are provided in said plate means for enabling a threadable attachment of said plate means to the handle of the driven hand tool.

12. An accessory device according to claim 10, wherein said radially outwardly projecting member is coupled to a lower end face of said central bushing means.

13. An accessory device according to claim 10, wherein said bushing means includes an internal threading for securing a fastening means for fixedly clamping said bushing means to said bearing means.

14. An accessory device according to claim 10, wherein said toolholder means is adapted to accommodate one of a grinding means, polishing means, corner grinding means, scraping means and slotting means.

15. An accessory device according to claim 12, wherein a securing point of the grinding disk to the toolholder means is offset with respect to a longitudinal center thereof.

16. An accessory device according to claim 12, wherein said toolholder means is adapted to accommodate one of a grinding means, polishing means, corner grinding means, scraping means and slotting means.

17. An accessory device for a driven hand tool including an output spindle means, the accessory device including a toolholder means, an eccentric head means adapted to be coupled to the output spindle means for rotation therewith, bearing means arranged in the eccentric head means and including an outer race means coupled to said eccentric head means, coupling means for coupling the toolholder means to a housing of the driven hand tool for restricting a freedom of movement of the toolholder means to a reciprocatory movement in dependence upon the eccentricity and to a superimposed pivoting motion about a point of the coupling means, a central bushing means mounted in said outer race means, said coupling means includes a plate means adapted to be secured to a handle of the driven hand tool, a radially outwardly projecting member coupled to said central bushing means, wherein said toolholder means is an independent structural assembly separate from said coupling means and said eccentric head means, said coupling means includes a connecting member interposed between said radially outwardly projecting member and said plate means, said connecting member includes a first portion disposed substantially parallel to a horizontal plane of the tool holder means and additional portions disposed on respective ends of said first portion and extending in a direction substantially perpendicular to the horizontal plane of the tool holder means whereby said connecting member is supported at said radially outwardly projecting member and said plate means so as to be pivotable about axes perpendicular to the horizontal plane of the tool holder means.

18. An accessory device according to claim 17, wherein means are provided in said plate means for enabling a threadable attachment of said plate means to the handle of the driven tool.

19. An accessory device according to claim 17, wherein said radially outwardly projecting member is coupled to a lower end face of said central bushing means.

20. An accessory device according to claim 17, wherein said bushing means includes an internal threading for securing a fastening means fixedly clamping said bushing means to said bearing means.

21. An accessory device according to claim 17, wherein said tool holder means is adapted to accommodate one of a grinding means, polishing means, corner grinding means, scraping means and slotting means.

* * * * *